US009481958B2

(12) United States Patent
Park

(10) Patent No.: US 9,481,958 B2
(45) Date of Patent: Nov. 1, 2016

(54) WASHING MACHINE

(75) Inventor: Sang Ho Park, Hwaseong-si (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 897 days.

(21) Appl. No.: 13/410,856

(22) Filed: Mar. 2, 2012

(65) Prior Publication Data

US 2012/0222454 A1 Sep. 6, 2012

(30) Foreign Application Priority Data

Mar. 4, 2011 (KR) ..... 10-2011-0019226

(51) Int. Cl.

| | |
|---|---|
| ***D06F 37/20*** | (2006.01) |
| ***D06F 37/26*** | (2006.01) |
| ***D06F 37/40*** | (2006.01) |
| *D06F 37/30* | (2006.01) |

(52) U.S. Cl.

CPC ..... *D06F 37/264* (2013.01); *D06F 37/20* (2013.01); *D06F 37/263* (2013.01); *D06F 37/40* (2013.01); *D06F 37/206* (2013.01); *D06F 37/30* (2013.01)

(58) Field of Classification Search

CPC .... D06F 37/264; D06F 37/269; D06F 37/30; D06F 37/40; D06F 37/36; D06F 37/48; D06F 37/20; D06F 37/206

USPC ..... 68/140, 142, 133

See application file for complete search history.

(56) References Cited

U.S. PATENT DOCUMENTS 5,040,285 A * 8/1991 Williams et al. ..... 29/596

FOREIGN PATENT DOCUMENTS

| | | | |
|---|---|---|---|
| CN | 201068529 Y | * | 6/2008 |
| CN | 201473774 U | * | 5/2010 |
| CN | 201722526 U | * | 1/2011 |
| JP | 11221396 A | * | 8/1999 |
| JP | 2000-254389 | | 9/2000 |
| JP | 2001-113089 | | 4/2001 |
| JP | 2003-326083 | | 11/2003 |
| KR | 1999-023979 | | 3/1999 |
| KR | 20-0170648 | | 9/1999 |
| KR | 2000-0062742 | | 10/2000 |
| KR | 2001-0000429 | | 1/2001 |

OTHER PUBLICATIONS

Machine translation of CN 201068529 Y, dated Jun. 2008.*
Machine translation of CN 201722526 U, dated Jan. 2011.*
Machine translation of KR1020000062742A, dated Oct. 25, 2000.*
Machine translation of JP 11221396 A, dated Aug. 1999.*
Korean Office Action issued Jul. 8, 2013.
Korean Office Action dated Apr. 1, 2016 from Korean Patent Application No. 10-2013-0046280, 12 pages.
Korean Notice of Allowance dated Oct. 21, 2013 from Korean Patent Application No. 10-2011-0019226, 6 pages.

* cited by examiner

*Primary Examiner* — Joseph L Perrin
*Assistant Examiner* — Kevin G Lee
(74) *Attorney, Agent, or Firm* — Staas & Halsey LLP

(57) ABSTRACT

A washing machine which is improved so as to firmly support a clutch. The washing machine includes a main body, a tub disposed within the main body, a drum rotatably disposed within the tub, a motor provided under the tub to provide driving force to rotate the drum, a clutch connected to the motor to transmit driving force of the motor to the drum, and a mounting plate to fix the clutch and the motor to connect the clutch and the motor to the lower surface of the tub. A first flange unit connected to the clutch is provided on the lower surface of the tub, and a second flange unit connected to the outer circumferential surface of the first flange unit is provided on the mounting plate.

9 Claims, 5 Drawing Sheets

WASHING MACHINE

CROSS-REFERENCE TO RELATED APPLICATIONS

This application claims the priority benefit of Korean Patent Application No. 10-2011-0019226, filed on Mar. 4, 2011 in the Korean Intellectual Property Office, the disclosure of which is incorporated herein by reference.

BACKGROUND

1. Field

Embodiments relate to a washing machine having a structure supporting a clutch selectively transmitting rotary force of a motor to a drum or a pulsator.

2. Description of the Related Art

A washing machine is an apparatus which washes laundry using electric power, and generally includes a tub to store wash water, a drum rotatably installed within the tub, a pulsator rotatably installed on the bottom of the drum, and a motor and a clutch to rotate the drum and the pulsator.

When the drum and the pulsator are rotated under the condition that laundry and wash water are placed within the drum, the pulsator agitates the laundry placed within the drum together with the wash water to remove dirt from the laundry.

The clutch mounted on the washing machine is connected to the drum and the pulsator and selectively transmits driving force generated from the motor to the drum and the pulsator.

In general, as the capacity of the washing machine increases, the diameters and heights of the tub and the drum increase and thus centrifugal force generated due to rotation of the drum increases. Since the centrifugal force is directly transmitted to a structure supporting the clutch through the clutch connected to the drum, reinforcement of the strength of the structure supporting the clutch to cope with the increasing centrifugal force is required.

SUMMARY

Therefore, it is an aspect of one or more embodiments to provide a washing machine which is improved so as to firmly support a clutch.

Additional aspects of one or more embodiments will be set forth in part in the description which follows and, in part, will be apparent from the description, or may be learned by practice.

In accordance with an aspect of one or more embodiments, a washing machine includes a main body, a tub disposed within the main body, a drum rotatably disposed within the tub, a motor provided under the tub to provide driving force to rotate the drum, a clutch connected to the motor to transmit driving force of the motor to the drum, a mounting plate to fix the clutch and the motor to connect the clutch and the motor to the lower surface of the tub, a first flange unit formed on the lower surface of the tub and connected to the clutch, and a second flange unit formed on the mounting plate and connected to the outer circumferential surface of the first flange unit to reinforce the strength of the first flange unit.

The first flange unit may protrude downwards from the lower surface of the tub to the outside of the tub, and a first insertion hole may be formed at the center of the first flange unit so that one end of the clutch is inserted into the first insertion hole and connected to the drum.

The second flange unit may protrude from one surface of the mounting plate in an opposite direction to the connecting direction of the mounting plate to the lower surface of the tub, and a second insertion hole may be formed at the center of the second flange unit so that the first flange unit is inserted into the second insertion hole.

The clutch may include a housing, a drive shaft rotatably supported by bearings connected to the inside of the housing, and a fixing plate extending from the outer circumferential surface of the housing to fix the clutch to the mounting plate.

The drive shaft may pass through the first flange unit and be connected to the drum.

The mounting plate may include a fixing unit connected to the fixing plate; and an accommodation part to accommodate the housing when the fixing plate and the fixing unit are connected, and the second flange unit may be provided at the accommodation part and protrudes to the inside of the accommodation part.

A protruding length of the second flange unit may be smaller than a depth of the accommodation part.

In accordance with another aspect of one or more embodiments, a washing machine includes a main body, a tub disposed within the main body and provided with a first flange unit protruding from the lower surface thereof, a drum rotatably disposed within the tub, a pulsator rotatably disposed within the drum, a motor provided under the tub, a clutch to selectively transmit driving force of the motor to the drum or the pulsator, and a mounting plate fixing the clutch and the motor and provided with a second flange unit connected to the first flange unit.

The clutch may include a housing including a fixing plate extending from the outer circumferential surface thereof so as to be fixed to the mounting plate, and a drive shaft rotatably supported by bearings connected to the inside of the housing.

The first flange unit may include a first flange wall protruding downwards from the lower surface of the tub to the outside of the tub and receiving one end of the housing within the first flange wall.

The second flange unit may include a second flange wall protruding downwards from one surface of the mounting plate and provided with an inner circumferential surface contacting the outer circumferential surface of the first flange wall.

The mounting plate may include a fixing unit connected to the fixing plate and an accommodation part to accommodate the housing when the fixing plate and the fixing unit are connected, and the second flange unit may be provided at the accommodation part and protrudes to the inside of the accommodation part.

A protruding length of the second flange unit may be smaller than a depth of the accommodation part.

In accordance with a further aspect of one or more embodiments, a washing machine includes a main body, a tub disposed within the main body to accommodate wash water, a drum rotatably disposed within the tub, a motor provided under the tub, and a clutch connected to the motor to transmit driving force of the motor to the drum, wherein the tub includes a flange unit protruding downwards from the lower surface of the tub to the outside of the tub and connected to the clutch, and a reinforcing member formed of a material having greater strength than the flange unit and connected to the outer circumferential surface to reinforce the strength of the flange unit.

The reinforcing member may be connected to the motor and the clutch.

BRIEF DESCRIPTION OF THE DRAWINGS

These and/or other aspects will become apparent and more readily appreciated from the following description of embodiments, taken in conjunction with the accompanying drawings of which.

DETAILED DESCRIPTION

Figure 1:
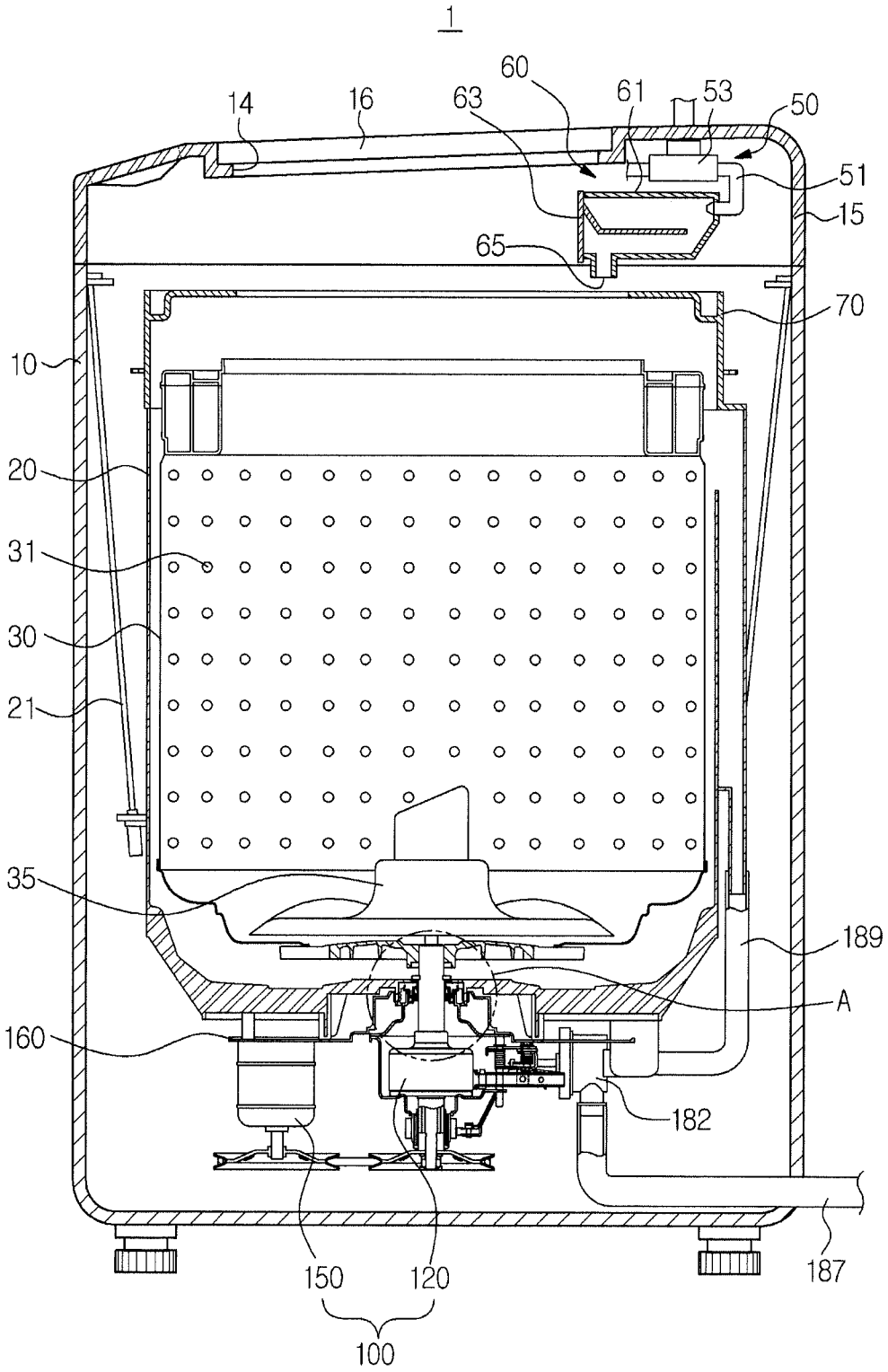
FIG. 1 is a cross-sectional view of a washing machine in accordance with an embodiment.

Reference will now be made in detail to embodiments, examples of which are illustrated in the accompanying drawings, wherein like reference numerals refer to like elements throughout.

FIG. 1 is a cross-sectional view of a washing machine in accordance with an embodiment.

As shown in FIG. 1, a washing machine 1 in accordance with the embodiment of the present invention includes a main body 10 forming the external appearance of the washing machine 1, a tub 20 disposed within the main body 10, a drum 30 rotatably disposed within the tub 20, and a drive device 100 disposed under the tub 20 to rotate the drum 30.

A cover 15 provided with a laundry inlet 14 through which laundry is placed within the drum 30 is provided on the upper surface of the main body 10, and a door 16 to open and close the laundry inlet 14 is provided on the cover 15.

Suspension devices 21 to suspend the tub 20 to support the tub 20 to the main body 10 are connected to the outer surface of the tub 20, and a ring-shaped tub cover 70 to cover the tub 20 is connected to the upper end of the tub 20.

The drum 30 is rotatably disposed within the tub 20, and is provided with a plurality of through holes 31.

A pulsator 35 is rotatably installed on the bottom of the drum 30, and serves to agitate laundry introduced into the drum 30 together with wash water.

A water supply device 50 to supply wash water to the tub 20 is installed above the tub 20. The water supply device 50 includes a water supply valve 53 to control water supply, and a water supply pipe 51 to connect the water supply valve 53 to a detergent supply device 60.

One end of the water supply pipe 51 is connected to an external water supply source (not shown), and the other end of the water supply pipe 51 is connected to the detergent supply device 60.

The detergent supply device 60 includes a case 61 provided within the cover 15, and a detergent container 63 detachably mounted in the case 61 to accommodate respective detergents. A discharge hole 65 to discharge wash water in which detergents dissolve is formed on the bottom surface of the case 61.

Water supplied through the water supply pipe 51 is supplied to the tub 20 together with the detergents via the detergent supply device 60.

The drive device 100 includes a clutch 120 to rotate the drum 30 and the pulsator 35, and a drive motor 150 to drive the clutch 120. The clutch 120 is connected to the drive motor 150 by a plurality of pulleys 134 and at least one belt 135, and selectively transmits drive force of the drive motor 150 to the drum 30 or the pulsator 35.

Figure 2:
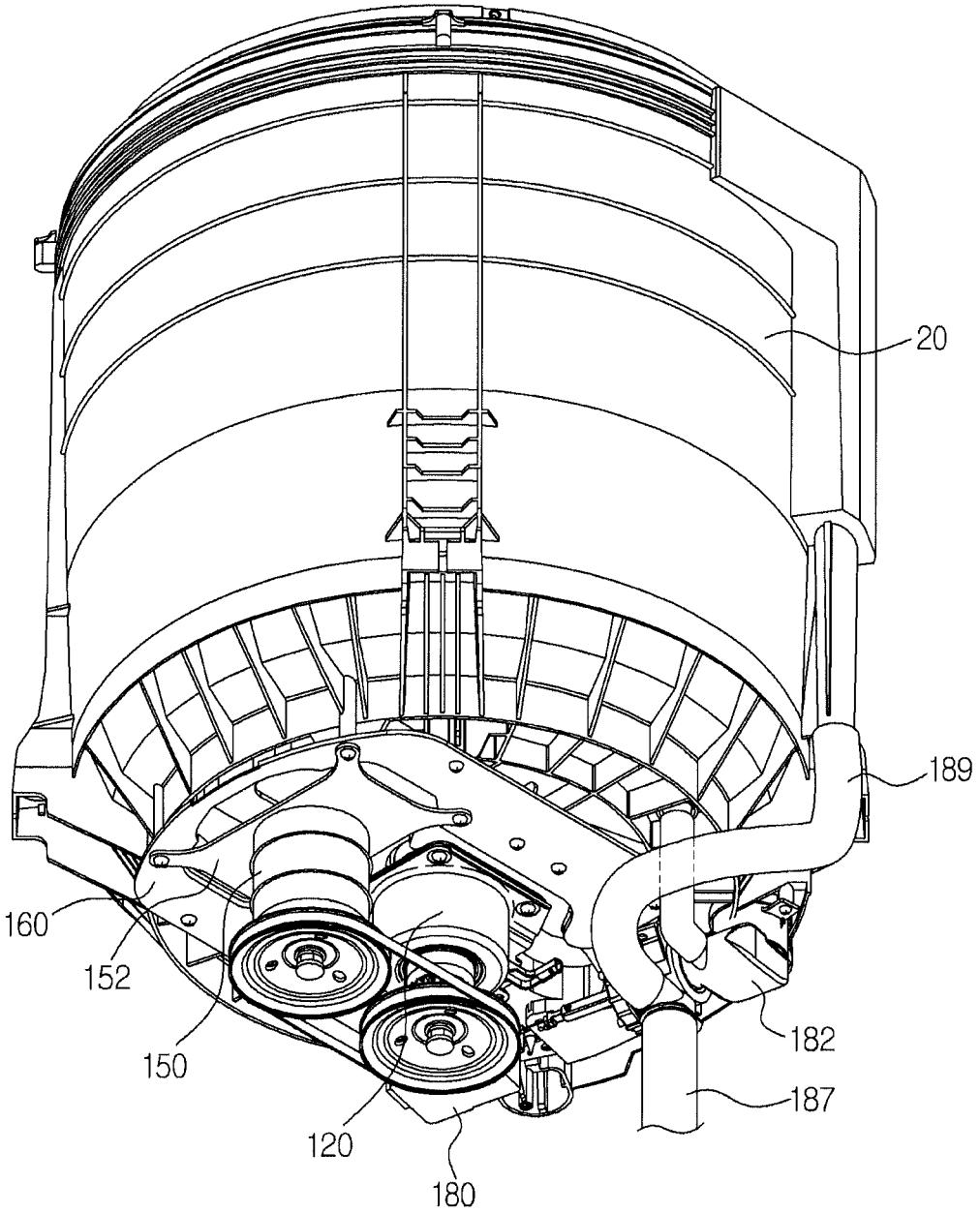
FIG. 2 is a bottom perspective view illustrating a motor and a clutch mounted on the lower surface of a tub.
Figure 3:
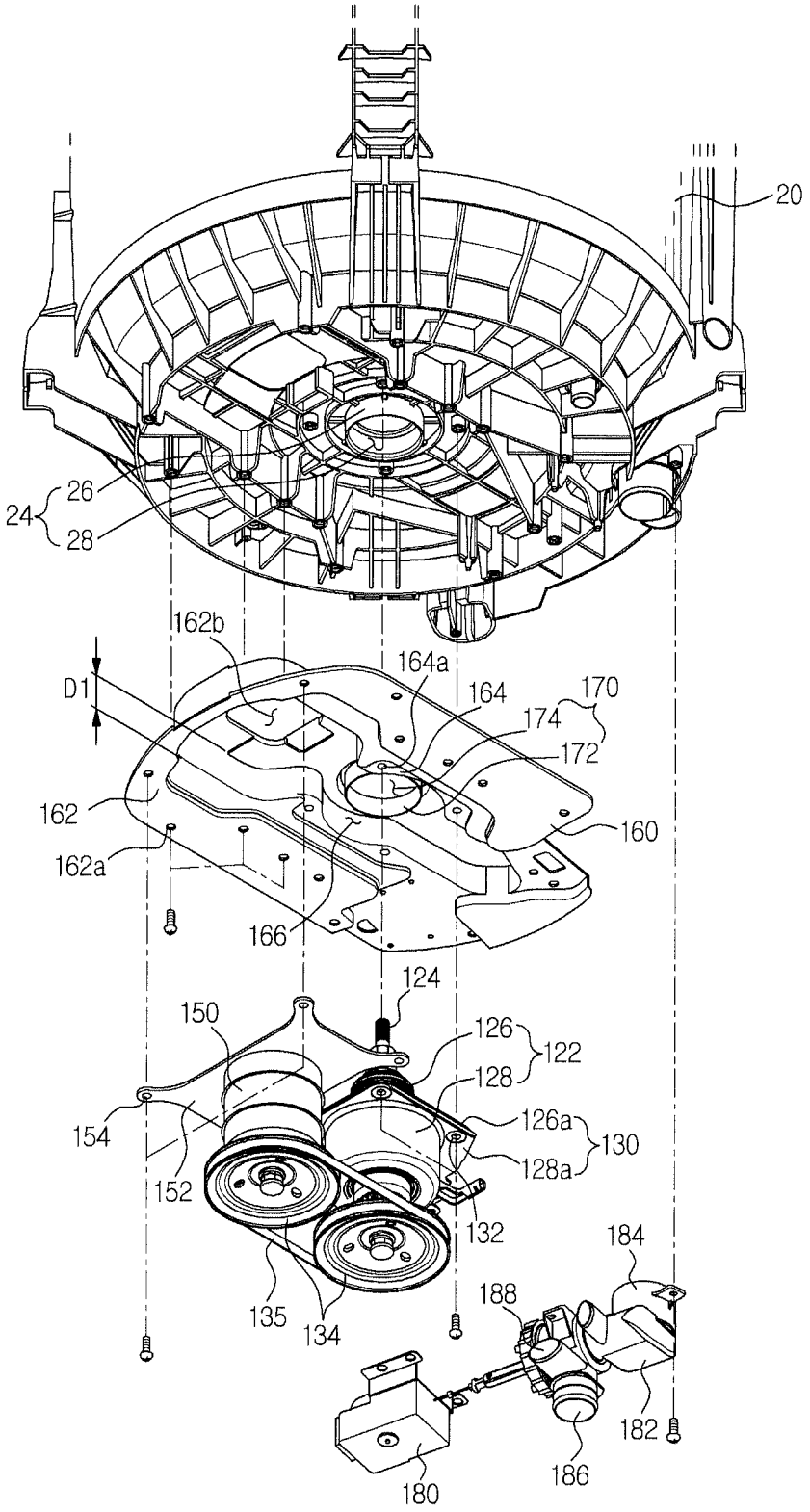
FIG. 3 is an exploded perspective view illustrating the clutch and a mounting plate.
Figure 4:
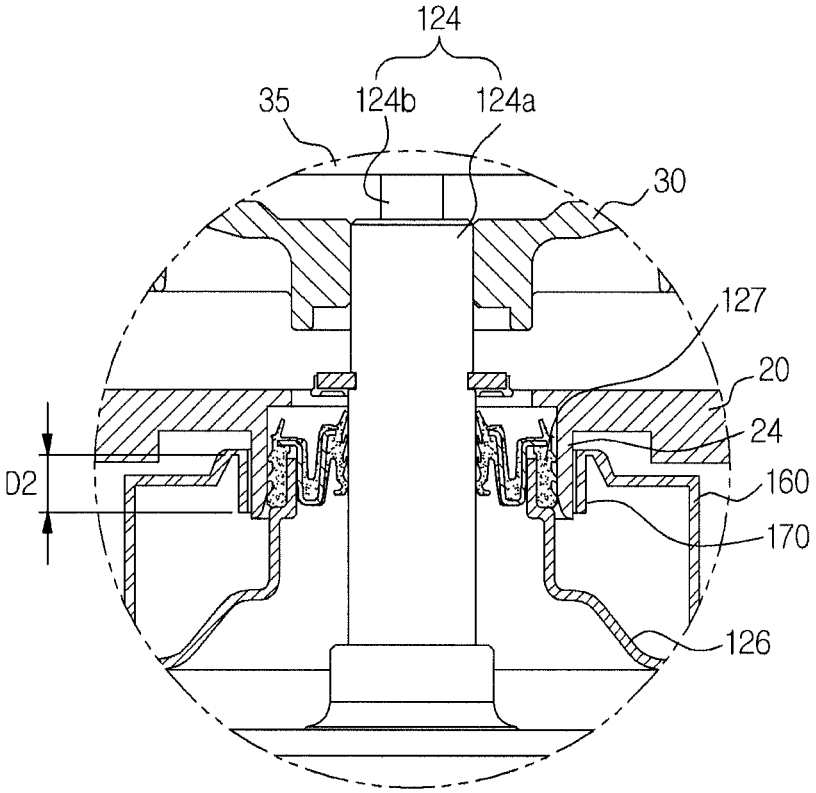
FIG. 4 is an enlarged cross-sectional view illustrating the portion 'A' of FIG. 1.
Figure 5:
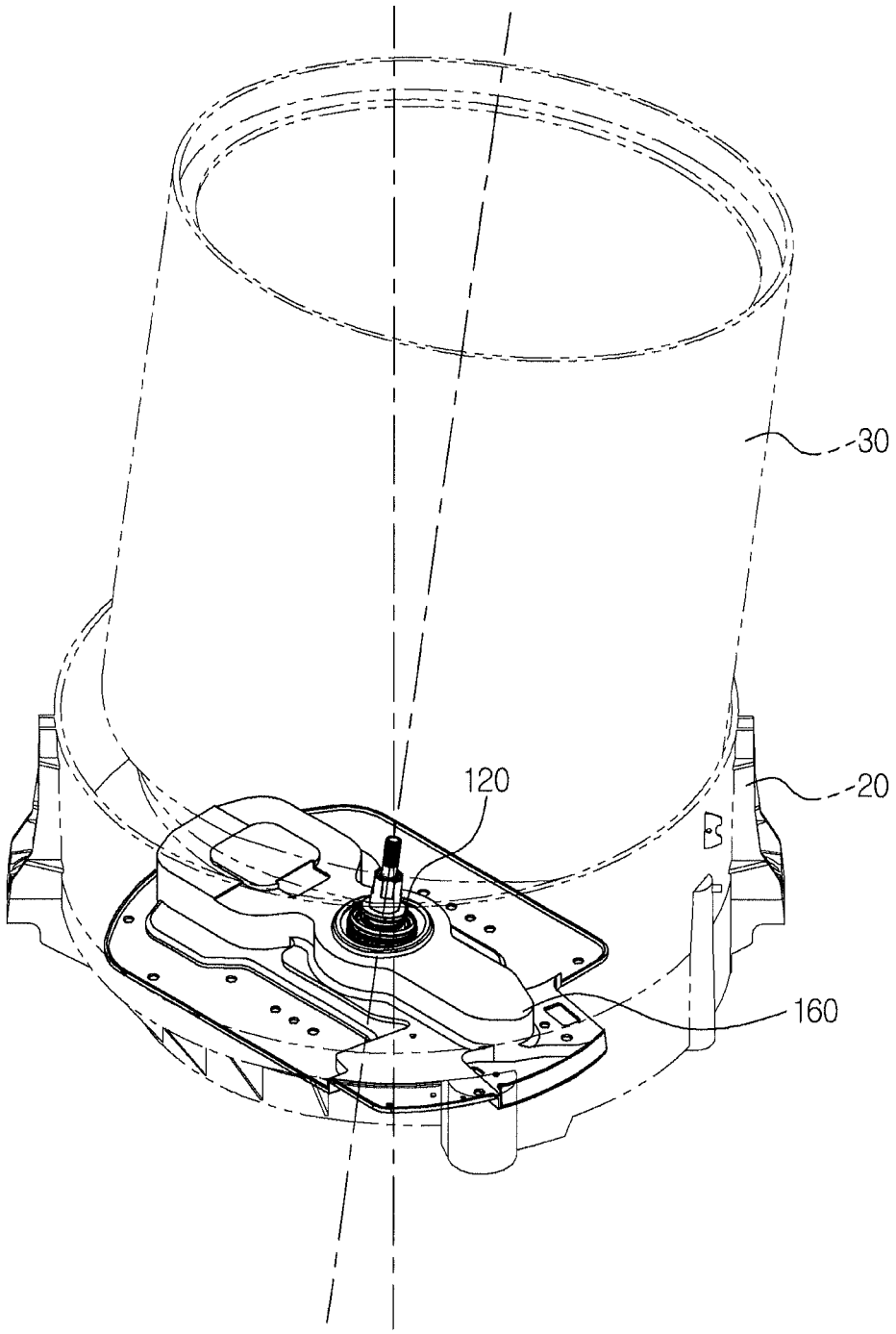
FIG. 5 is a perspective view illustrating eccentric rotation of a drum due to centrifugal force.

FIG. 2 is a bottom perspective view illustrating the motor and the clutch mounted on the lower surface of the tub, FIG. 3 is an exploded perspective view illustrating the clutch and a mounting plate, FIG. 4 is an enlarged cross-sectional view illustrating the portion 'A' of FIG. 1, and FIG. 5 is a perspective view illustrating eccentric rotation of the drum due to centrifugal force.

As shown in FIGS. 1 to 5, the clutch 120 and the drive motor 150 are fixed to a mounting plate 160 and are disposed under the lower surface of the tub 20.

A first flange unit 24 to receive and support the clutch 120 is formed on the lower surface of the tub 20.

The first flange unit 24 includes a first flange wall 26 protruding downwards from the lower surface of the tub 20 to the outside of the tub 20, and a first insertion hole 28 formed at the inside of the first flange wall 26 so that one end of the clutch 120 is inserted into the first insertion hole 28. The first flange unit 24 supports the clutch 120 to prevent movement of the clutch 120 during rotation of the drum 30.

The clutch 120 includes a housing 122, and a drive shaft 124 rotatably connected to the center of the housing 122.

The housing 122 includes an upper housing 126 and a lower housing 128, the insides of which are hollow, and the upper housing 126 and the lower housing 128 are connected to each other through bonding plates **126*a* and 128*a*, each of which extends from the outer circumferential surface of one end of each of the upper and lower housings 126 and 128. The bonding plates 126*a* and 128*a* are bonded to form a fixing plate 130, and first fixing holes 132 to fix the clutch 120 to the mounting plate 160 are provided at the corners of the fixing plate 130**.

A sealing member 127 is connected to the outer circumferential surface of one end of the upper housing 126. The sealing member 127 is located between the upper housing 126 and the inner circumferential surface of the first flange wall 26 and prevents leakage of wash water contained in the tub 20.

Various bearings to rotatably support the drive shaft 124 and deceleration devices to decelerate the drive shaft 124 are provided in an inner space formed by connecting the upper housing 126 and the lower housing 128.

The drive shaft 124 passes through the first flange unit 24 formed on the tub 20 and a second flange unit 170 formed on the mounting plate 160, and is connected to the drum 30 and the pulsator 35.

A first connection part **124*a* connected to the drum 30 and a second connection part 124*b* protruding from the upper end of the first connection part 124*a* and connected to the pulsator 35 are formed at one end of the drive shaft 124. The first connection part 124*a* and the second connection part 124*b* are simultaneously or separately rotated according to a washing process or a spin-drying process. That is, during the washing process, the second connection part 124*b* is rotated and thus the pulsator 35 connected to the second connection part 124*b* is rotated, and during the spin-drying process, the first connection part 124*a* and the second connection part 124*b* are simultaneously rotated and thus the drum 30 and the pulsator 35 are simultaneously rotated. The pulley 134 is connected to the other end of the drive shaft 124 and transmits rotary force of the drive motor 150 to the clutch 120**.

The mounting plate 160 serves to fix the drive motor 150 and the clutch 120 to dispose the drive motor 150 and the clutch 120 on the lower surface of the tub 20, and includes a first fixing unit 162 to fix the drive motor 150, a second fixing unit 164 to fix the clutch 120, an accommodation part 166 to accommodate a portion of the clutch 120 when the clutch 120 is fixed to the mounting plate 160, and the second flange unit 170 provided on the lower surface of the tub 20 and connected to the first flange unit 24.

The first fixing unit 162 includes through holes 162*a* provided at positions corresponding to second fixing holes 154 formed on a fixing bracket 152 to fix the drive motor 150 to the mounting plate 160, and a cooling part 162*b* passing through a portion of the mounting plate 160 to effectively cool the drive motor 150.

The second fixing unit 164 includes through holes 164*a* provided at positions corresponding to the first fixing holes 132 formed on the fixing plate 130, and the accommodation part 166 accommodating the upper housing 126 when the clutch 120 is fixed to the mounting plate 160, is formed to a designated depth D1 at the inside of the second fixing unit 164.

The second flange unit 170 connected to the first flange unit 24 provided on the lower surface of the tub 20 is formed at the accommodation part 166. The second flange unit 170 includes a second flange wall 172 protruding from one surface of the mounting plate 160 to the inside of the accommodation part 166, i.e., in an opposite direction to the connecting direction of the mounting plate 160 to the lower surface of the tub 20, to a designated length D2, and a second insertion hole 174 formed at the inside of the second flange wall 172 so that the first flange unit 24 is inserted into the second insertion hole 174. The protruding length D2 of the second flange wall 172 may be smaller than the depth D1 of the accommodation part 166 so as to prevent interference between the upper housing 126 and one end of the second flange wall 172 when the clutch 120 is connected to the mounting plate 160.

The second flange unit 170 is connected to the first flange unit 24 when the mounting plate 160 is connected to the lower surface of the tub 20, thereby supporting the first flange unit 24. The inner circumferential surface of the second flange wall 172 contacts the outer circumferential surface of the first flange wall 26, thus supporting the first flange unit 24. As shown in FIG. 5, centrifugal force generated due to rotation of the drum 30 is transmitted to the first flange unit 24 of the tub 20 supporting the clutch 120 through the clutch 120 connected to the drum 30 and may cause local deformation of the shape of the lower portion of the tub 20 including the first flange unit 24 and such deformation may cause eccentric rotation of the clutch 120 and the drum 30. However, the second flange unit 170 supports the first flange unit 24, and thus allows the drum 30 to be stably rotated without eccentric rotation and reduces noise generated due to eccentric rotation of the drum 30.

Further, the second flange unit 170 improves assembly characteristics of the mounting plate 160. Since the first flange unit 24 and the second flange unit 170 are disposed to be concentric with the tub 20, the drum 30 and the drive shaft 124 of the clutch 120, an assembly position of the mounting plate 160 may be easily set using the first flange unit 24 and the second flange unit 170 during a process of assembling the mounting plate 160 with the lower surface of the tub 20.

A drain motor 180 and a channel case 182 connected to the drain motor 180 may be connected to the mounting plate 160. The channel case 182 includes a connection pipe 184 connected to the tub 20, a drain pipe 186 to drain wash water introduced through the connection pipe 184, and an overflow pipe 188 to drain wash water contained to a designated level or more in the tub 20. The overflow pipe 188 is connected to the tub 20 through an overflow hose 189, and a drain hose 187 is connected to the drain pipe 186 to guide wash water to the outside of the main body 10. A valve (not shown) is provided between the connection pipe 184 and the drain pipe 186, and the drain motor 180 is connected to the valve so that wash water in the tub 20 is selectively drained by opening and closing the valve during the washing process.

The mounting plate 160 serves as a reinforcing member to reinforce the overall strength of the tub 20. The mounting plate 160 is formed of an iron plate having greater strength than the tub 20 formed by injection molding using a plastic material, and is connected to the lower surface of the tub 20 to reinforce the strength of the tub 20. Further, the second flange unit 170 may more firmly support the first flange unit 24 due to a strength difference between materials of the mounting plate 160 and the tub 20.

As is apparent from the above description, in a washing machine in accordance with an embodiment, a clutch is firmly supported, and thus a drum connected to the clutch is stably rotated.

Further, noise generated during rotation of the drum is reduced.

Although a few embodiments have been shown and described, it would be appreciated by those skilled in the art that changes may be made in embodiments without departing from the principles and spirit of the invention, the scope of which is defined in the claims and their equivalents.

What is claimed is:

1. A washing machine comprising:

a main body;

a tub disposed within the main body;

a drum rotatably disposed within the tub;

a motor provided under the tub to provide driving force to rotate the drum;

a clutch connected to the motor to transmit driving force of the motor to the drum, the clutch including a housing;

a mounting plate to fix the clutch and the motor to connect the housing of the clutch and the motor to the lower surface of the tub;

a first flange unit formed on the lower surface of the tub and connected to the clutch;

a second flange unit formed on the mounting plate and connected to the outer circumferential surface of the first flange unit; and a sealing member connected to an outer circumferential surface of the housing, wherein the second flange unit protrudes from one surface of the mounting plate in an opposite direction to the connecting direction of the mounting plate to the lower surface of the tub and is configured to be in parallel line contact with the first flange unit to reinforce the strength of the first flange unit, and the second flange unit and the sealing member are in contact with and sandwich the first flange unit to prevent leakage of wash water contained in the tub.

2. The washing machine according to claim 1, wherein:

the first flange unit protrudes downwards from the lower surface of the tub to the outside of the tub; and a first insertion hole is formed at the center of the first flange unit so that one end of the clutch is inserted into the first insertion hole and connected to the drum.

3. The washing machine according to claim 2, wherein a second insertion hole is formed at the center of the second flange unit so that the first flange unit is inserted into the second insertion hole.

4. The washing machine according to claim 1, wherein the clutch further includes:

a drive shaft rotatably supported by bearings connected to the inside of the housing; and a fixing plate extending from the outer circumferential surface of the housing to fix the clutch to the mounting plate.

5. The washing machine according to claim 4, wherein the drive shaft passes through the first flange unit and is connected to the drum.

6. The washing machine according to claim 5, wherein the mounting plate includes:

a fixing unit connected to the fixing plate; and an accommodation part to accommodate the housing when the fixing plate and the fixing unit are connected; and the second flange unit is provided at the accommodation part and protrudes to the inside of the accommodation part.

7. The washing machine according to claim 6, wherein a protruding length of the second flange unit is smaller than a depth of the accommodation part.

8. A washing machine comprising a main body, a tub disposed within the main body to accommodate wash water, a drum rotatably disposed within the tub, a motor provided under the tub, and a clutch connected to the motor to transmit driving force of the motor to the drum, wherein the tub includes:

a flange unit protruding downwards from the lower surface of the tub to the outside of the tub and connected to the clutch;

a reinforcing member formed of a material having greater strength than the flange unit and connected to the outer circumferential surface to reinforce the strength of the flange unit; and a sealing member positioned on an inner circumferential surface of the flange unit, wherein the reinforcing member includes a flange that protrudes from one surface of the reinforcing member in a same direction as the protruding direction of the flange unit is configured to be in parallel line contact with the outer circumferential surface of the flange unit to reinforce the strength of the flange unit, and the reinforcing member and the sealing member are in contact with and sandwich the flange unit to prevent leakage of the wash water accommodated in the tub.

9. The washing machine according to claim 8, wherein the reinforcing member is connected to the motor and the clutch, and the sealing member is connected to a housing of the clutch.

* * * * *